US012559870B2

(12) United States Patent
Tang et al.

(10) Patent No.: US 12,559,870 B2
(45) Date of Patent: Feb. 24, 2026

(54) METHOD FOR PREPARING FULL-DULL COTTON-LIKE POLYESTER FIBERS

(71) Applicant: JIANGSU HENGLI CHEMICAL FIBRE CO., LTD., Wujiang (CN)

(72) Inventors: Fangming Tang, Wujiang (CN); Lili Wang, Wujiang (CN); Zhengping Yuan, Wujiang (CN); Cunhong Wei, Wujiang (CN); Jiangen Shen, Wujiang (CN); Yuanhua Zhang, Wujiang (CN)

(73) Assignee: JIANGSU HENGLI CHEMICAL FIBRE CO., LTD., Wujiang (CN)

( * ) Notice: Subject to any disclaimer, the term of this patent is extended or adjusted under 35 U.S.C. 154(b) by 0 days.

(21) Appl. No.: 18/723,467

(22) PCT Filed: Nov. 2, 2022

(86) PCT No.: PCT/CN2022/129190
§ 371 (c)(1),
(2) Date: Jun. 24, 2024

(87) PCT Pub. No.: WO2023/116215
PCT Pub. Date: Jun. 29, 2023

(65) Prior Publication Data

US 2025/0059684 A1 Feb. 20, 2025

(30) Foreign Application Priority Data

Dec. 24, 2021 (CN) ..... 202111596510.6

(51) Int. Cl.
*D02G 3/04* (2006.01)
*D02G 1/02* (2006.01)
*D02G 1/08* (2006.01)

(52) U.S. Cl.
CPC ..... *D02G 3/045* (2013.01); *D02G 1/0206* (2013.01); *D02G 1/028* (2013.01); *D02G 1/08* (2013.01); *D10B 2331/04* (2013.01)

(58) Field of Classification Search
CPC ..... D02G 1/02; D02G 1/0266; D02G 1/0286; D02G 1/08; D02G 1/20; D02G 1/0206; D02G 1/028; D02G 3/04
See application file for complete search history.

(56) References Cited

U.S. PATENT DOCUMENTS 3,680,302 A * 8/1972 Hess ..... D02G 1/02 57/348
4,853,021 A * 8/1989 Soszka ..... C03C 25/20 57/286

(Continued)

FOREIGN PATENT DOCUMENTS

CN 1598103 A 3/2005
CN 102277667 A 12/2011

(Continued)

OTHER PUBLICATIONS

FZ/T 50001-2005, Testing method for interlacing degree of synthetic filament yarns, China National Standards, 2005, pp. 1-10, National Development and Reform Commission.

(Continued)

*Primary Examiner* — Patrick J. Lynch
(74) *Attorney, Agent, or Firm* — Bayramoglu Law Offices LLC

(57) ABSTRACT

A method for preparing full-dull cotton-like polyester fibers includes: sequentially passing a full-dull polyester POY fiber and a full-dull polyester FDY fiber through a first yarn guide, a yarn guide tube, a second yarn guide, a first yarn feeding roller, pre-entangling, a second yarn feeding roller, a first deformation hot box, a cooling plate, a false twister, a third yarn feeding roller, a middle entangling device, a (Continued)

setting hot box, a setting yarn feeding roller, oiling, and DTY winding and forming to obtain the same. The first and second yarn guides are both yarn guide wheels; a tow is wound around the first yarn feeding roller for 2-3 turns; an inferior angle of the tow before and after contacting a groove bottom of the second yarn guide is 140°-160°; a linear velocity ratio of the first yarn feeding roller to the second yarn feeding roller is 1.05-1.06.

9 Claims, 2 Drawing Sheets

(56) References Cited

U.S. PATENT DOCUMENTS 6,199,361 B1 * 3/2001 Yakushi ..... D02G 1/08 57/244
6,209,302 B1 * 4/2001 Wortmann ..... D02G 1/082 57/280
6,477,828 B1 * 11/2002 Nolle ..... D02G 1/0266 57/332

FOREIGN PATENT DOCUMENTS

| | | | | | |
|---|---|---|---|---|---|
| CN | 103320923 | B | * | 8/2015 | |
| CN | 107557932 | A | | 1/2018 | |
| CN | 112831875 | A | | 5/2021 | |
| CN | 113215699 | A | | 8/2021 | |
| CN | 114232160 | A | | 3/2022 | |
| EP | 3121315 | A1 | * | 1/2017 | ..... D01H 13/12 |
| GB | 851817 | A | * | 10/1960 | ..... D02G 1/028 |
| JP | H03260135 | A | | 11/1991 | |
| JP | H06128830 | A | | 5/1994 | |

OTHER PUBLICATIONS

GB/T 14344-2008, Testing method for tensile of man-made filament yarns, China National Standards, 2005, pp. 1-10, General Administration of Quality Supervision, Inspection and Quarantine of the People's Republic of China & Standardization Administration of the People's Republic of China.

Xiaoyan Liu, et al., Friction Coeficient lest And Analysis of High-Performance Fibers, Sichuan Textile Technology, 2001, pp. 15-17.

* cited by examiner

METHOD FOR PREPARING FULL-DULL COTTON-LIKE POLYESTER FIBERS

CROSS REFERENCE TO THE RELATED APPLICATIONS

This application is the national phase entry of International Application No. PCT/CN2022/129190, filed on Nov. 2, 2022, which is based upon and claims priority to Chinese Patent Application No. 202111596510.6, filed on Dec. 24, 2021, the entire contents of which are incorporated herein by reference.

TECHNICAL FIELD

The present invention belongs to the technical field of polyester fibers, and more particularly, relates to a method for preparing full-dull cotton-like polyester fibers.

BACKGROUND

The main varieties of polyester filaments on the market currently include pre-oriented yarn (POY), fully drawn yarn (FDY), drawn textured yarn (DTY) and so on. In order to broaden the application of polyester filaments, cotton-like polyester fibers have been studied and developed, including cotton-like polyester fibers obtained by using the POY and the FDY as raw materials to prepare the DTY However, in general, the fiber surface of ordinary polyester filaments will have different intensities of gloss, if the gloss of the surface is too strong, the obtained textiles will not very comfortable to look at. Therefore, in order to reduce the intensity of gloss to make it more suitable for the cotton-like effect, researchers added a small amount of substances with different refractive indices during the fiber polymerization process, which reduces the smoothness of the fiber surface and makes the incident light diffusely reflected in different directions, so the intensity of gloss of the fiber surface is reduced. The amount of matting agent added to full-dull cotton-like polyester fibers is generally 1.0-3.0%, and titanium dioxide is mostly used as the matting agent. However, inorganic additives such as matting agents will cause the raw material tow to be rough, and during a short time, the first yarn guide and the second yarn guide will be worn out into grooves, reducing the service life of the yarn guides; generally, the first yarn guide and the second yarn guide will be worn out within 3-5 days, and the wear between the tow and the yarn guides will also have a negative impact on the performance of the full-dull cotton-like polyester fiber, specifically reflected in that: the interlacing jet cannot tighten the network of the cotton-like polyester fiber, causing network derailment. Therefore, in the subsequent weaving process of the cotton-like polyester fiber, the network is small, and due to the physical properties of two raw yarns in the cotton-like polyester fiber are not the same, the dual-filament embrace is poor, resulting in many broken ends during the weaving process, and there will be knots and lumps on the fabric, leading to an uneven cloth surface, which seriously affects the performance of the product.

Therefore, it is of great significance to study a method that can solve the wear of the yarn guide and ensure the performance of cotton-like polyester fibers.

SUMMARY

The purpose of the invention is to solve the above problems existing in the prior art, and to provide a method for preparing full-dull cotton-like polyester fibers.

To this end, the technical schemes of the invention are as follows:

A method for preparing full-dull cotton-like polyester fibers, wherein a full-dull polyester POY fiber and a full-dull polyester FDY fiber are sequentially passed through a first yarn guide, a yarn guide tube, a second yarn guide, a first yarn feeding roller, pre-entangling, a second yarn feeding roller, a first deformation hot box, a cooling plate, a false twister, a third yarn feeding roller, a middle entangling device, a setting hot box, a setting yarn feeding roller, oiling, and DTY winding and forming to obtain the full-dull cotton-like polyester fiber;

wherein the first yarn guide and the second yarn guide are both fixed pulley yarn guide wheels;

wherein a tow contacts grooves of the first yarn guide and the second yarn guide in a process of movement, driving the first yarn guide and the second yarn guide to rotate;

wherein the tow is wound around the first yarn feeding roller for 2-3 turns (the winding of 2-3 turns is done manually at the beginning of the process when drawing in the yarn), the tow is fed by winding on the first feeding roller to achieve 100% grip and accurately control the tension of the tow; if the tension is stably controlled, the wear can be controlled;

wherein an inferior angle (i.e. 20) of the tow before and after contacting a groove bottom of the second yarn guide is 140°-160° (the first yarn guide can provide guidance, and there is no special requirement for the angle between the tow and the first yarn guide);

wherein a linear velocity ratio of the first yarn feeding roller to the second yarn feeding roller is 1.05-1.06, forming a certain overfeeding ratio, which facilitates the formation of pre-entangling.

The following preferred technology program is presented to give a detailed description for this invention:

The said method for preparing full-dull cotton-like polyester fibers, wherein the first yarn guide and the second yarn guide are the same in shape and size.

The said method for preparing full-dull cotton-like polyester fibers, wherein a rim width of the yarn guide wheel is 20-25 mm, an outer diameter of an outer wheel is 9.4-10.7 mm, and an inner diameter of the groove bottom is 6-7.4 mm.

The said method for preparing full-dull cotton-like polyester fibers, wherein the material of the yarn guide wheel is ceramic, a surface hardness of the groove bottom is 1500-2000 HV, and a friction coefficient between the groove bottom and the tow is 0.2-0.22 (the friction coefficient refers to the test method in the article "*Friction Coefficient Test And Analysis of High-Performance Fibers*").

The said method for preparing full-dull cotton-like polyester fibers, wherein a tension value of the tow during pre-entangling is 2.5-3.5 cN, and the tension of the tow during pre-entangling is still within this range after one year of continuous DTY texturing.

The said method for preparing full-dull cotton-like polyester fibers, wherein specifications of the full-dull polyester POY fiber and the full-dull polyester FDY fiber are both 192 dtex/108f.

The said method for preparing full-dull cotton-like polyester fibers, wherein the full-dull polyester POY fiber and the full-dull polyester FDY fiber both contain a matting agent of titanium dioxide, and the content is 2.2-2.5 wt %.

The said method for preparing full-dull cotton-like polyester fibers, wherein main process parameters are: a pre-entangling jet air pressure of 3.2-3.5 bar, a pre-entangling jet aperture of 1.5-1.7 mm, a first deformation hot box temperature of 180-195° C., a setting hot box temperature of 150-160° C., a linear velocity ratio (stretching ratio) of the third yarn feeding roller to the second yarn feeding roller of 1.1-1.14, a winding speed of 500-600 m/min, a setting overfeeding rate of 4.0-5.0%, and a winding overfeeding rate of 2.0-3.0%.

The said method for preparing full-dull cotton-like polyester fibers, wherein the full-dull cotton-like polyester fiber has a breaking strength of 2.1-2.3 cN/dtex (Test standard: GB/T 14344), an interlacing degree of 100-105/m (Test standard: FZ/T 50001-2005), and a CV value of breaking strength ≤6.00%;

wherein change rates of the breaking strength, the interlacing degree and the CV value of breaking strength of the full-dull cotton-like polyester fiber prepared by continuous production for 60 days are not higher than 10%; that is, compared with the production of the full-dull cotton-like polyester fiber on the first day, after continuous production for two months, the breaking strength and the interlacing degree of the prepared full-dull cotton-like polyester fiber decrease by no more than 10%, and the CV value of breaking strength increases by no more than 10%.

The principle of the present invention is as follows:

The full-dull cotton-like polyester fiber needs to be treated with a matting agent, which will make the surface of the tow rough, since the first yarn guide and the second yarn guide cannot rotate around the axis in the existing texturing process of the full-dull cotton-like polyester fiber, there is a sliding friction between the tow and the yarn guides, which leads to the wear of the first yarn guide and the second yarn guide within 3-5 days when the full-dull cotton-like polyester fiber is using DTY texturing process. The invention discusses the reasons for the wear of the yarn guides: the full-dull cotton-like polyester fiber is elasticized by a pre-entangling process, since the first yarn guide and the second yarn guide are worn out with grooves for a short time, the resistance tension generated when the tow passes through grooves is large, resulting in the tension of the tow becoming larger when passing through the first yarn guide and the second yarn guide, which can be increased to 20-25 cN; the tension will be transmitted to the tows of the first yarn feeding roller and the second yarn feeding roller, since the grip of the first yarn feeding roller is that the two outer circles contact and press the grip, the grip is insufficient and cannot reach 100%, and there is slippage, therefore the 20-25 cN tension at the yarn guides will increase the tow tension to 6-8 cN during pre-entangling, the tension of the tow is too large so that the interlacing jet cannot tighten the network of the tow, causing network derailment.

In order to make the full-dull cotton-like polyester fiber have good cohesion and the softness of natural cotton fiber, it is very important to choose the appropriate interlacing degree. The larger the interlacing degree and interlacing fastness, the better the bundle of the tow, but if the interlacing degree and interlacing fastness are too large, it will make the tow be tight, the fabric feel hard and the cotton feel worse; the smaller the interlacing degree and interlacing fastness, the fluffier and softer the tow, but if the interlacing degree and interlacing fastness are too small, it will make the bundle of the tow worse, or even no cohesion, resulting in uneven dyeing of the fabric and poor cotton feel. Therefore, a high stability of the tow tension is required.

Therefore, by replacing the first yarn guide and the second yarn guide in the prior art with yarn guide wheels, the invention is able to change the friction between the tow and the yarn guide from sliding friction to rolling friction, which can not only reduce the wear of the yarn guides, but also greatly reduce the tension of the tow when passing through the first yarn guide and the second yarn guide.

After the invention replaces the first yarn guide and the second yarn guide by yarn guide wheels, the tension of the tow is greatly reduced, but at the same time, the tension of the tow will be difficult to control and be unstable, leading to jittering of the tow. In order to solve the problem at the same time, the invention adjusts the inferior angle of the tow before and after contacting the groove bottom of the second yarn guide to 140°-160° (because it is necessary to ensure that not only reduce the jittering of the tow, but also make the contact area between the tow and the yarn guide is not too large; if the angle is too small, the contact area between the tow and the yarn guide will be too large and increase friction, so a larger obtuse angle is used); the tow has the above angle on the second yarn guide, which will convert the pressure of the second yarn guide on the tow into the tension of the tow, resulting in less jitter, and the tow will be confined to the groove bottom of the second yarn guide, making the tow more stable; and the first yarn feeding roller is changed from pressing and holding to gripping by winding the tow on the roller, the point contact is changed to surface contact, which increases the friction and ensures 100% grip, and can accurately control the tension of the tow during pre-entangling through overfeeding (i.e., the linear velocity ratio of the first yarn feeding roller to the second yarn feeding roller), ensuring the stable tension of the yarn (i.e., the winding of the tow increases the contact area, and 2-3 turns of winding of the tow can be regarded as surface contact; 1 turn does not have enough holding force, and more than 3 turns may cause wear of the tow from the roller due to the large friction force). The invention sets the linear velocity ratio (overfeed ratio) of the first yarn feeding roller to the second yarn feeding roller to 1.05-1.06 to form overfeeding, so that the tension of the tow during pre-entangling is 2.5-3.5 cN, which enables stable netting without producing loose nets or floating yarns.

Benefits (1) The method for preparing full-dull cotton-like polyester fibers of the invention, can improve the interlacing degree of the tow, and do not loosen, which makes the surface of the fabric obtained later smooth and not easy to break;

(2) The method for preparing full-dull cotton-like polyester fibers of the invention, can reduce the wear of the first yarn guide and the first yarn guide, avoiding the loss of resources;

(3) The method for preparing full-dull cotton-like polyester fibers of the invention, wherein the prepared cotton-like polyester fiber has a good performance.

wherein the numbers in the figures are respectively represented: 1—the full-dull polyester POY fiber and the full-dull polyester FDY fiber, 2—first yarn guide, 3—yarn guide tube, 4—second yarn guide, 5—first yarn feeding roller, 6—pre-entangling, 7—second yarn feeding roller, 8—first deformation hot box, 9—cooling plate, 10—false twister, 11—third yarn feeding roller, 12—middle entangling device, 13—setting hot box, 14—setting yarn feeding roller, and 15—oiling.

DETAILED DESCRIPTION OF THE EMBODIMENTS

Based on above mentioned method, the following embodiments are carried out for further demonstration in the present invention. It is to be understood that these embodiments are only intended to illustrate the invention and are not intended to limit the scope of the invention. In addition, it should be understood that after reading the contents described in the present invention, those technical personnel in this field can make various changes or modifications to the invention, and these equivalent forms also fall within the scope of the claims attached to the application.

In the examples of the invention, the breaking strength, the interlacing degree and the CV value of breaking strength of the full-dull cotton-like polyester fiber prepared on the first day refer to the average value of the performances of the full-dull cotton-like polyester fiber obtained on the first full day of production; the breaking strength, the interlacing degree and the CV value of breaking strength of the full-dull cotton-like polyester fiber prepared after 60 days of continuous production refer to the average value of the performances of the full-dull cotton-like polyester fiber obtained on the 60th full day of production.

Figure 1:
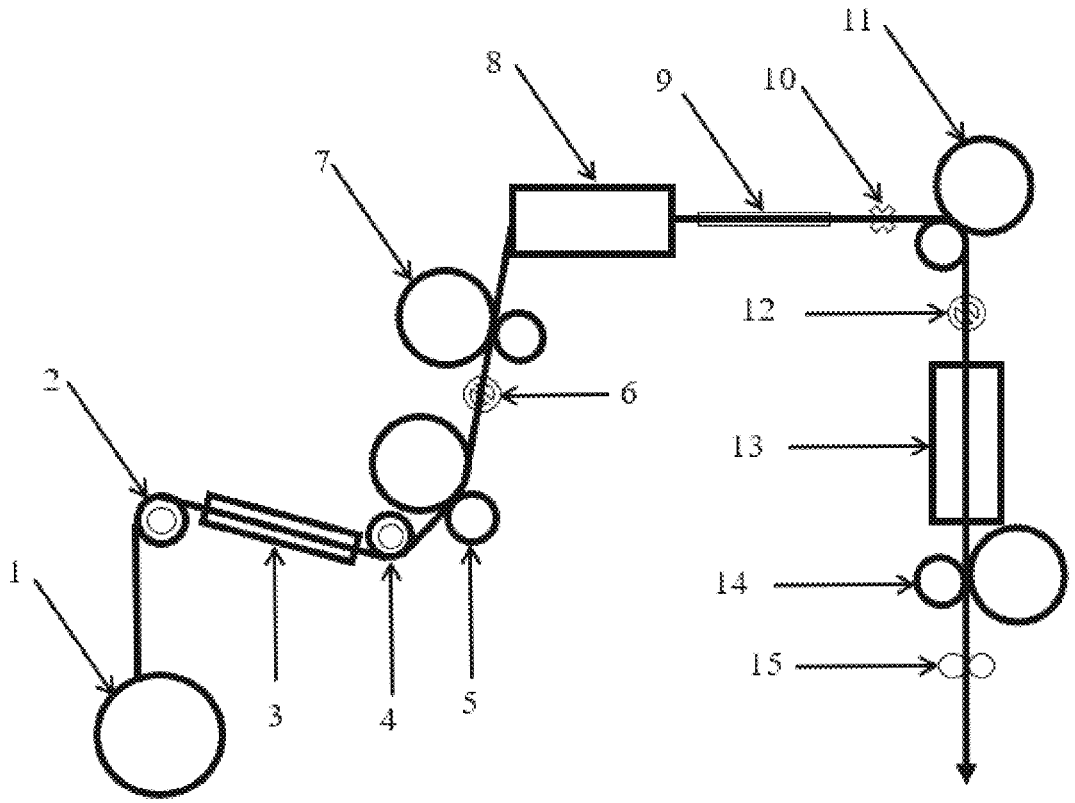
FIG. 1 is a flow chart of the preparation process of the invention.

The process of preparing the full-dull cotton-like polyester fiber by using DTY texturing process is as follows: as shown in FIG. 1, the full-dull polyester POY fiber and the full-dull polyester FDY fiber 1 containing the matting agent of titanium dioxide are sequentially passed through a first yarn guide 2, a yarn guide tube 3, a second yarn guide 4, a first yarn feeding roller 5, pre-entangling 6, a second yarn feeding roller 7, a first deformation hot box 8, a cooling plate 9, a false twister 10, a third yarn feeding roller 11, a middle entangling device 12, a setting hot box 13, a setting yarn feeding roller 14, oiling 15, and DTY winding and forming to obtain the full-dull cotton-like polyester fiber.

Example 1

Figure 2:
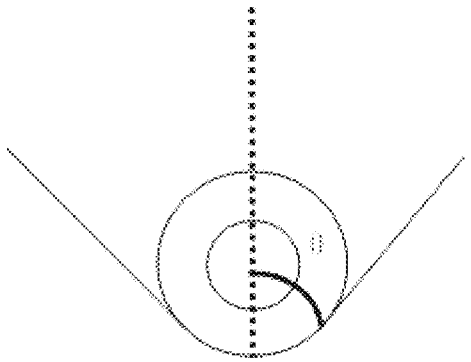
FIG. 2 is a schematic diagram of the positional relationship between the tow and the second yarn guide in the process of movement.
Figure 3:
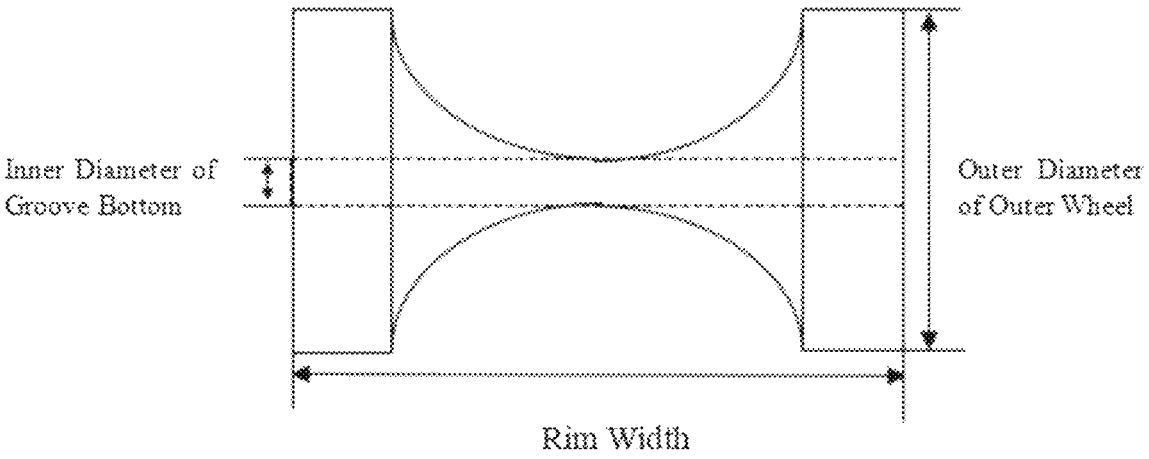
FIG. 3 is a schematic diagram of sectional structure of the yarn guide wheel of the invention.

A method for preparing full-dull cotton-like polyester fibers, using the said DTY texturing process, wherein specifications of the full-dull polyester POY fiber and the full-dull polyester FDY fiber are both 192 dtex/108f, and contents of the matting agent titanium dioxide in the full-dull polyester POY fiber and the full-dull polyester FDY fiber are both 2.2 wt %; wherein the first yarn guide and the second yarn guide are both yarn guide wheels, and are the same in shape and size, the material of the yarn guide wheel is ceramic, the surface hardness of the groove bottom is 1500 HV, and the friction coefficient between the groove bottom and the tow is 0.20; as shown in FIG. 3, wherein the rim width of the yarn guide wheel is 20 mm, the outer diameter of the outer wheel is 9.4 mm, and the inner diameter of the groove bottom is 6 mm; wherein the tow contacts groove bottoms of the first yarn guide and the second yarn guide in the process of movement, driving the first yarn guide and the second yarn guide to rotate; wherein the tow is wound around the first yarn feeding roller for 2 turns; as shown in FIG. 2, wherein the inferior angle of the tow before and after contacting the groove bottom of the second yarn guide is 140°;

wherein process parameters are: a pre-entangling jet air pressure of 3.2 bar, a pre-entangling jet aperture of 1.5 mm, a first deformation hot box temperature of 180° C., a setting hot box temperature of 150° C., a linear velocity ratio of the first yarn feeding roller to the second yarn feeding roller is 1.05, a linear velocity ratio of the third yarn feeding roller to the second yarn feeding roller of 1.1, a winding speed of 500 m/min, a setting overfeeding rate of 4%, and a winding overfeeding rate of 2%.

Adopting the above process for continuous production, the tension of the tow during pre-entangling is 2.7 cN; wherein the full-dull cotton-like polyester fiber prepared on the first day has a breaking strength of 2.3 cN/dtex, an interlacing degree of 105/m, and a CV value of breaking strength of 5.45%;

wherein the full-dull cotton-like polyester fiber prepared after 60 days of continuous production has a breaking strength of 2.2 cN/dtex, an interlacing degree of 101/m, and a CV value of breaking strength of 5.85%.

Comparison 1

A method for preparing full-dull cotton-like polyester fibers, basically the same as Example 1, except for that: the first yarn guide and the second yarn guide are both yarn guide rollers that cannot be rolled. The full-dull cotton-like polyester fiber prepared on the first day has a breaking strength of 2.3 cN/dtex, an interlacing degree of 95/m, and a CV value of breaking strength of 5.8%; the full-dull cotton-like polyester fiber prepared after 10 days of continuous production has a breaking strength of 1.9 cN/dtex, an interlacing degree of 68/m, and a CV value of breaking strength of 8.3%. After 60 days, it can no longer be produced. Comparing Example 1 with Comparison 1, it can be seen that the breaking strength, the interlacing degree, and the CV value of breaking strength of the full-dull cotton-like polyester fiber have changed significantly, because the wear of the first yarn guide and the second yarn guide has a greater impact on the quality of fibers.

Example 2

A method for preparing full-dull cotton-like polyester fibers, using the said DTY texturing process, wherein specifications of the full-dull polyester POY fiber and the full-dull polyester FDY fiber are both 192 dtex/108f, and contents of the matting agent titanium dioxide in the full-dull polyester POY fiber and the full-dull polyester FDY fiber are both 2.3 wt %; wherein the first yarn guide and the second yarn guide are both yarn guide wheels, and are the same in shape and size, the material of the yarn guide wheel is ceramic, the surface hardness of the groove bottom is 1800 HV, and the friction coefficient between the groove bottom and the tow is 0.20; wherein the rim width of the yarn guide wheel is 20 mm, the outer diameter of the outer wheel is 9.4 mm, and the inner diameter of the groove bottom is 6.2 mm; wherein the tow contacts groove bottoms of the first yarn guide and the second yarn guide in the process of movement, driving the first yarn guide and the second yarn guide to rotate; wherein the tow is wound around the first yarn feeding roller for 2 turns; wherein the inferior angle of the tow before and after contacting the groove bottom of the second yarn guide is 145°;

wherein process parameters are: a pre-entangling jet air pressure of 3.2 bar, a pre-entangling jet aperture of 1.5 mm, a first deformation hot box temperature of 185° C., a setting hot box temperature of 155° C., a linear velocity ratio of the first yarn feeding roller to the second yarn feeding roller is 1.06, a linear velocity ratio of the third yarn feeding roller to the second yarn feeding roller of 1.12, a winding speed of 520 m/min, a setting overfeeding rate of 4.2%, and a winding overfeeding rate of 2.2%.

Adopting the above process for continuous production, the tension of the tow during pre-entangling is 2.5 cN; wherein the full-dull cotton-like polyester fiber prepared on the first day has a breaking strength of 2.2 cN/dtex, an interlacing degree of 103/m, and a CV value of breaking strength of 5.24%;

wherein the full-dull cotton-like polyester fiber prepared after 60 days of continuous production has a breaking strength of 2.1 cN/dtex, an interlacing degree of 100/m, and a CV value of breaking strength of 5.58%.

Example 3

A method for preparing full-dull cotton-like polyester fibers, using the said DTY texturing process, wherein specifications of the full-dull polyester POY fiber and the full-dull polyester FDY fiber are both 192 dtex/108f, and contents of the matting agent titanium dioxide in the full-dull polyester POY fiber and the full-dull polyester FDY fiber are both 2.4 wt %; wherein the first yarn guide and the second yarn guide are both yarn guide wheels, and are the same in shape and size, the material of the yarn guide wheel is ceramic, the surface hardness of the groove bottom is 1880 HV, and the friction coefficient between the groove bottom and the tow is 0.22; wherein the rim width of the yarn guide wheel is 23 mm, the outer diameter of the outer wheel is 10.2 mm, and the inner diameter of the groove bottom is 7 mm; wherein the tow contacts groove bottoms of the first yarn guide and the second yarn guide in the process of movement, driving the first yarn guide and the second yarn guide to rotate; wherein the tow is wound around the first yarn feeding roller for 3 turns; wherein the inferior angle of the tow before and after contacting the groove bottom of the second yarn guide is 150°;

wherein process parameters are: a pre-entangling jet air pressure of 3.5 bar, a pre-entangling jet aperture of 1.6 mm, a first deformation hot box temperature of 192° C., a setting hot box temperature of 157° C., a linear velocity ratio of the first yarn feeding roller to the second yarn feeding roller is 1.06, a linear velocity ratio of the third yarn feeding roller to the second yarn feeding roller of 1.14, a winding speed of 550 m/min, a setting overfeeding rate of 4.8%, and a winding overfeeding rate of 2.5%.

Adopting the above process for continuous production, the tension of the tow during pre-entangling is 3.5 cN; wherein the full-dull cotton-like polyester fiber prepared on the first day has a breaking strength of 2.2 cN/dtex, an interlacing degree of 104/m, and a CV value of breaking strength of 5.33%;

wherein the full-dull cotton-like polyester fiber prepared after 60 days of continuous production has a breaking strength of 2.1 cN/dtex, an interlacing degree of 101/m, and a CV value of breaking strength of 5.78%.

Example 4

A method for preparing full-dull cotton-like polyester fibers, using the said DTY texturing process, wherein specifications of the full-dull polyester POY fiber and the full-dull polyester FDY fiber are both 192 dtex/108f, and contents of the matting agent titanium dioxide in the full-dull polyester POY fiber and the full-dull polyester FDY fiber are both 2.5 wt %; wherein the first yarn guide and the second yarn guide are both yarn guide wheels, and are the same in shape and size, the material of the yarn guide wheel is ceramic, the surface hardness of the groove bottom is 2000 HV, and the friction coefficient between the groove bottom and the tow is 0.22; wherein the rim width of the yarn guide wheel is 25 mm, the outer diameter of the outer wheel is 10.7 mm, and the inner diameter of the groove bottom is 7.4 mm; wherein the tow contacts groove bottoms of the first yarn guide and the second yarn guide in the process of movement, driving the first yarn guide and the second yarn guide to rotate; wherein the tow is wound around the first yarn feeding roller for 4 turns; wherein the inferior angle of the tow before and after contacting the groove bottom of the second yarn guide is 160°;

wherein process parameters are: a pre-entangling jet air pressure of 3.5 bar, a pre-entangling jet aperture of 1.7 mm, a first deformation hot box temperature of 195° C., a setting hot box temperature of 160° C., a linear velocity ratio of the first yarn feeding roller to the second yarn feeding roller is 1.05, a linear velocity ratio of the third yarn feeding roller to the second yarn feeding roller of 1.12, a winding speed of 600 m/min, a setting overfeeding rate of 5%, and a winding overfeeding rate of 3%.

Adopting the above process for continuous production, the tension of the tow during pre-entangling is 2.8 cN; wherein the full-dull cotton-like polyester fiber prepared on the first day has a breaking strength of 2.3 cN/dtex, an interlacing degree of 100/m, and a CV value of breaking strength of 5.14%;

wherein the full-dull cotton-like polyester fiber prepared after 60 days of continuous production has a breaking strength of 2.1 cN/dtex, an interlacing degree of 97/m, and a CV value of breaking strength of 5.42%.

What is claimed is:

1. A method for preparing a full-dull cotton-like polyester fiber, comprising: sequentially passing a full-dull polyester pre-oriented yarn (POY) fiber and a full-dull polyester fully drawn yarn (FDY) fiber through a first yarn guide, a yarn guide tube, a second yarn guide, a first yarn feeding roller, pre-entangling, a second yarn feeding roller, a first deformation hot box, a cooling plate, a false twister, a third yarn feeding roller, a middle entangling device, a setting hot box, a setting yarn feeding roller, and oiling to obtain the full-dull cotton-like polyester fiber, wherein each of the first yarn guide and the second yarn guide is a yarn guide wheel;

wherein a tow contacts a groove bottom of the first yarn guide and a groove bottom of the second yarn guide in a process of a movement, driving the first yarn guide and the second yarn guide to rotate;

wherein the tow is wound around the first yarn feeding roller for 2-3 turns;

wherein an inferior angle of the tow before and after contacting the groove bottom of the second yarn guide is 140°-160°; and wherein a linear velocity ratio of the first yarn feeding roller to the second yarn feeding roller is 1.05-1.06.

2. The method of claim 1, wherein a shape and a size of the first yarn guide are identical to a shape and a size of the second yarn guide.

3. The method of claim 2, wherein a rim width of the yarn guide wheel is 20-25 mm, an outer diameter of an outer wheel is 9.4-10.7 mm, and an inner diameter of the groove bottom of the first yarn guide or the second yarn guide is 6-7.4 mm.

4. The method of claim 1, wherein a material of the yarn guide wheel is ceramic, a surface hardness of the groove bottom of the first yarn guide or the second yarn guide is 1500-2000 HV, and a friction coefficient between the groove bottom of the first yarn guide or the second yarn guide and the tow is 0.2-0.22.

5. The method of claim 1, wherein a tension value of the tow during pre-entangling is 2.5-3.5 cN.

6. The method of claim 1, wherein specifications of the full-dull polyester POY fiber and the full-dull polyester FDY fiber are both 192 dtex/108f.

7. The method of claim 1, wherein the full-dull polyester POY fiber and the full-dull polyester FDY fiber both contain a matting agent, a content of the matting agent is 2.2-2.5 wt %, and the matting agent is titanium dioxide.

8. The method of claim 1, wherein main process parameters are: a pre-entangling jet air pressure of 3.2-3.5 bar, a pre-entangling jet aperture of 1.5-1.7 mm, a first deformation hot box temperature of 180-195° C., a setting hot box temperature of 150-160° C., a linear velocity ratio of the third yarn feeding roller to the second yarn feeding roller of 1.1-1.14, a winding speed of 500-600 m/min, a setting overfeeding rate of 4.0-5.0%, and a winding overfeeding rate of 2.0-3.0%.

9. The method of claim 1, wherein the full-dull cotton-like polyester fiber has a breaking strength of 2.1-2.3 cN/dtex, an interlacing degree of 100-105/m, and a CV value of breaking strength ≤6.00%.

* * * * *